United States Patent [19]

Wolf

[11] 4,265,212

[45] May 5, 1981

[54] HAND CATAPULT

[75] Inventor: Rodney A. Wolf, Stevens Point, Wis.

[73] Assignee: Weber Tackle Company, Stevens Point, Wis.

[21] Appl. No.: 870,420

[22] Filed: Jan. 18, 1978

[51] Int. Cl.[3] ..... F41B 7/00

[52] U.S. Cl. ..... 124/20 A; 124/50

[58] Field of Search ..... 124/20 R, 20 A, 20 B, 124/41 R, 49, 50, 52, 53, 25, 88, 89, 17; 22/4

[56] References Cited

U.S. PATENT DOCUMENTS

| | | | |
|---|---|---|---|
| 2,324,201 | 7/1943 | Donaldson | 124/20 R |
| 2,532,798 | 12/1950 | Wright | 124/20 B |
| 2,585,663 | 2/1952 | Laubly | 124/20 R |
| 2,820,444 | 1/1958 | Pedersen | 124/20 R |
| 3,306,278 | 2/1967 | Spatari | 124/22 |
| 3,683,882 | 8/1972 | Braxton | 124/20 A X |
| 3,901,209 | 8/1975 | Woolsey et al. | 124/20 R |
| 3,983,860 | 10/1976 | Bolton | 124/20 R |
| 4,050,439 | 9/1977 | Rudy | 124/20 R |

FOREIGN PATENT DOCUMENTS

| | | | |
|---|---|---|---|
| 860155 | 9/1940 | France | 124/20 R |

*Primary Examiner*—William R. Browne

*Attorney, Agent, or Firm*—Allegretti, Newitt, Witcoff & McAndrews

[57] ABSTRACT

A hand catapult including a shaped handle designed to conform to the hand of the user, a semi-circular carriage secured to the top of the handle in offset relationship to the longitudinal axis of the handle, resilient band for hurling a missile, and swivel carriage bindings for connecting the resilient band to the carriage. The handle includes handle core to provide heft and weight for improved feel and handling and to permit various accessories to be attached easily to the handle. The accessories may include a leather carrying strap, a wrist brace to provide greater stability for better aiming, and an ammunition tube attachment.

13 Claims, 16 Drawing Figures

Fig. 5
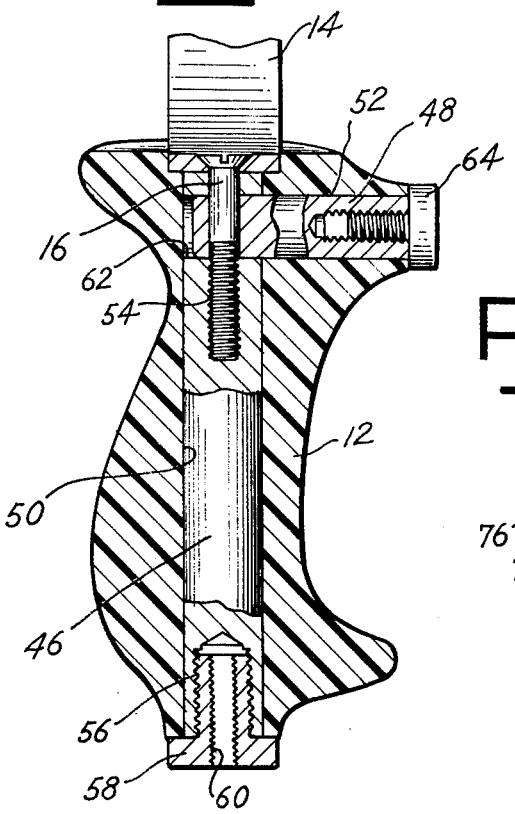
Fig. 6
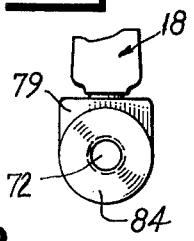
Fig. 7
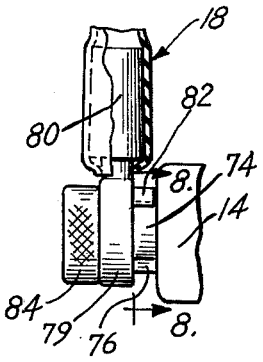
Fig. 8
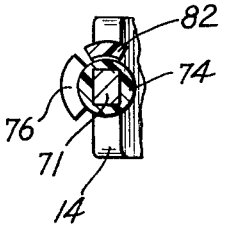
Fig. 9
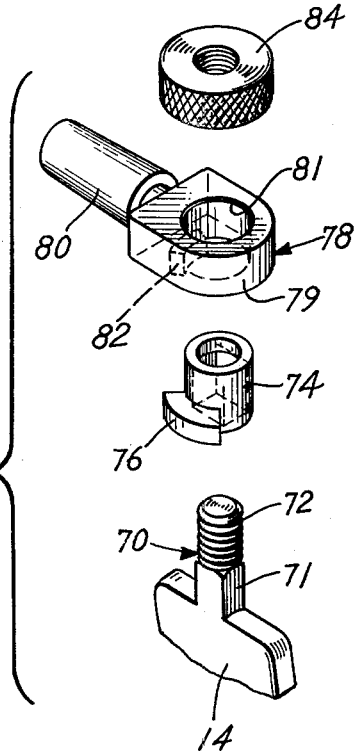
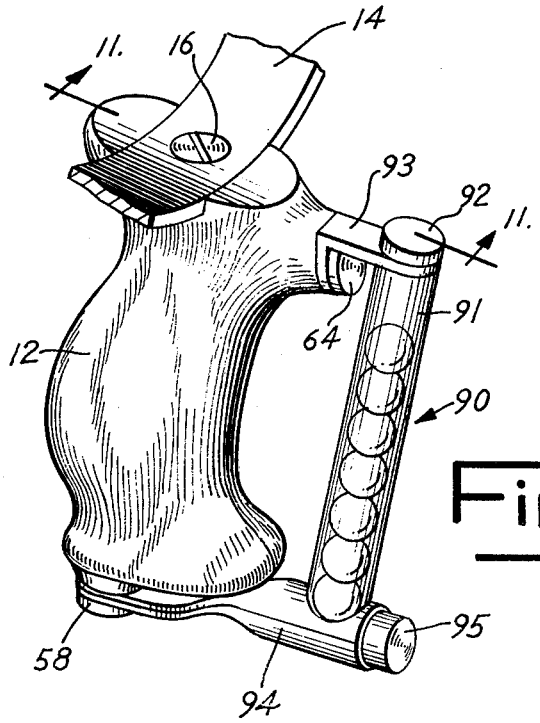
Fig. 10

Fig. 11
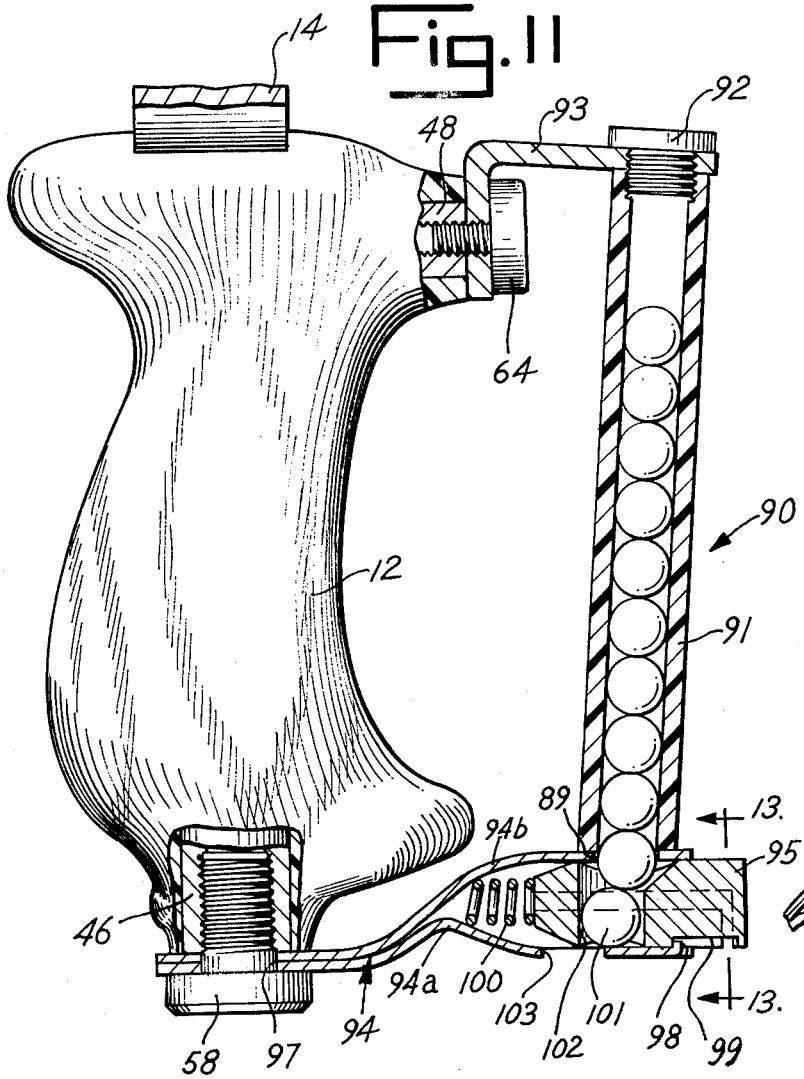
Fig. 12
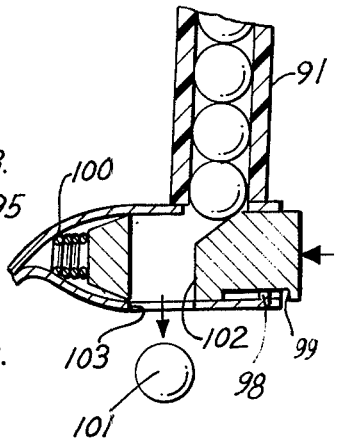
Fig. 14
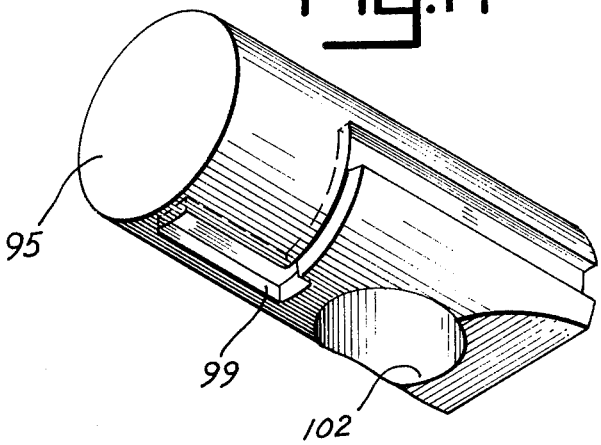
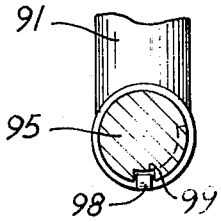
Fig. 13

HAND CATAPULT

BACKGROUND AND SUMMARY OF THE INVENTION

This invention relates to a hand catapult and, more particularly, to an improved hand catapult provided with a shaped handle with steel handle core means for affording heft and stability, and an offset carriage which allows a natural arm position in use. The handle core means readily accommodates accessories and attachments. Among the accessories are a wrist strap for reducing strain while shooting and eliminating the chance of dropping the hand catapult between shots, a wrist brace to provide greater stability to the wrist for accurate aiming, and an ammunition tube for carrying extra missiles or balls.

Slingshots or hand catapults have been used for many years as hunting weapons and recreation devices. Essentially, a slingshot comprises a stock or frame generally Y-shaped in configuration, having a handle portion and a pair of spaced-apart arms forming a fork. Resilient band means is secured to the fork arms. The center of the resilient band means forms a pocket for a missile to be hurled, or alternatively, a pocket of leather or like material is joined between the sides of the resilient band means. The frame can be crudely made, as for example, from a forked tree branch, with a resilient band secured at each end to the arms. Alternatively, the frame can be made in a more sophisticated fashion, by molding plastic or similar modern fabrication techniques.

Prior art slingshot frames have generally been fabricated from a single member of assembled components wherein the handle and the ends of the arms of the U-shaped or V-shaped portion of the frame were coaxial. In use, it has been found to be a strain to hold the slingshot in proper sighting, cocking and shooting positions .

Users of slingshots attempt to compensate for the strain resulting from aiming and cocking the slingshot by tensioning the resilient band by tilting the whole slingshot.

An object of this invention is to provide an improved carefully designed and engineered hand catapult wherein the disadvantages and deficiencies of prior constructions are obviated.

Another object of the present invention is to provide an improved hand catapult having a carriage secured to the handle means in an offset manner to provide for most efficient sighting and use of the hand catapult.

Another object of this invention is to provide an improved hand catapult having a handle provided with handle core means to permit ready affixation of the carriage and accessories to the handle.

Yet another object of this invention is to provide an improved hand catapult having an offset carriage secured to the handle, and swivel carriage bindings for connecting the resilient band means to the carriage.

Still another object of this invention is to provide an improved hand catapult with attachments that can be selectively secured to the handle means for steadying the hand catapult in use, such attachments including a wrist strap and a wrist brace.

A further object of this invention is to provide an improved hand catapult having handle core means within the handle adapted to receive an ammunition tube attachment for carrying an additional supply of missiles to be hurled by the hand catapult, said missiles adapted to be released one at a time from the ammunition tube.

Other objects and advantages of the present invention will be made more apparent hereinafter.

DESCRIPTION OF THE DRAWING

There is shown in the attached drawing presently preferred embodiments of the present invention, wherein like numerals in the various views refer to like elements and wherein:

FIG. 5 is a cross-section of the hand catapult taken generally along the line 5—5 of FIG. 4;

FIG. 6 is a plan view of a swivel binding of the present invention taken generally along the line 6—6 of FIG. 4;

FIG. 7 is a detail view illustrating the connection of the swivel binding to the carriage;

FIG. 8 is a cross-sectional view of a swivel binding of the hand catapult taken generally along the line 8—8 of FIG. 7;

FIG. 9 is an exploded perspective view of the swivel binding and its connection to the carriage;

FIG. 10 is a perspective view of the hand catapult illustrating an ammunition tube attachment connected thereto;

FIG. 11 is an elevation view, partially in cross-section, better illustrating details of the ammunition tube attachment, with the dispensing button in missile retention position;

FIG. 12 is an enlarged detail view of the ammunition tube attachment, illustrating the dispensing button in missile releasing position;

FIG. 13 is a detail view taken generally along the line 13—13 of FIG. 11;

FIG. 14 is a perspective view of the dispensing button utilized with the ammunition tube attachment shown in FIG. 11;

DETAILED DESCRIPTION OF THE PRESENT INVENTION

Figure 1:
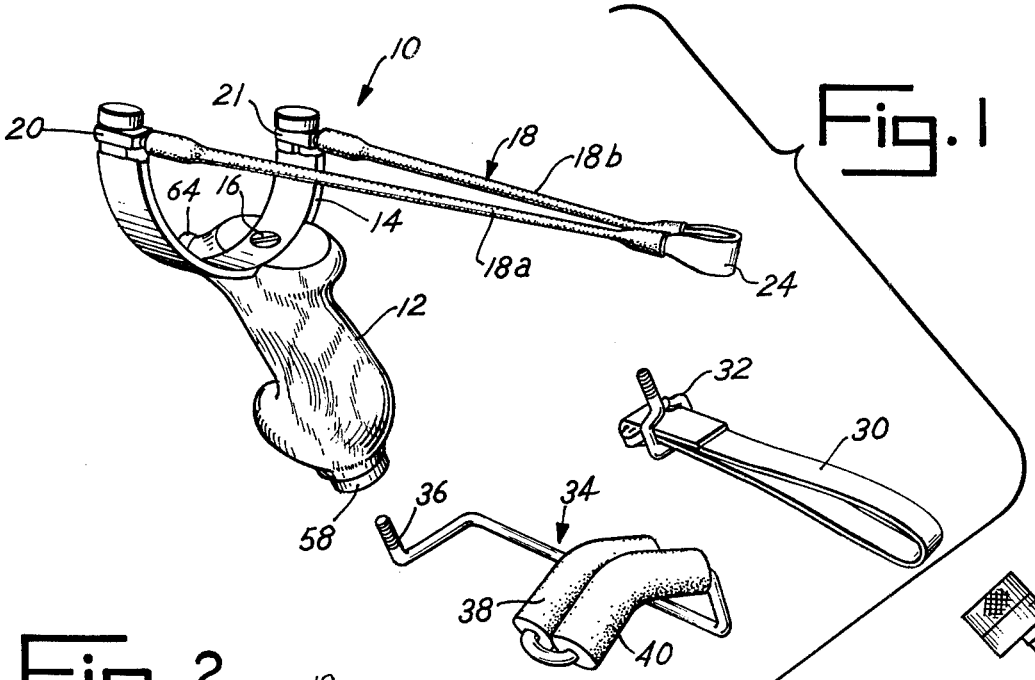
FIG. 1 is a perspective view of the novel hand catapult of the present invention, also illustrating a carrying strap attachment and a wrist brace attachment that can be utilized with the hand catapult.

There is shown in FIG. 1 a perspective illustrating the hand catapult 10 of the present invention. Basically, the hand catapult 10 comprises a shaped handle 12, a carriage 14 secured by a bolt 16 to the handle 12, and resilient band means 18 connected to the carriage by means of the swivel means 20, 21. The resilient band means 18 includes side **18*a* and 18*b*, which are connected at their forward ends to the swivel means 20, 21, respectively, and at the rear to a pouch 24 for receiving a missile, ball or pellet to be hurled by the hand catapult 10**.

The resilient band means 18 is preferably of the type disclosed in my prior U.S. Pat. No. 3,923,034 and reference may be made thereto for a more detailed description of the resilient band means. Briefly, the resilient band means 18 is molded from rubber or a like resilient material and is tapered from front to rear so as to produce velocities greater than for conventional band means to improve the operating efficiency for the hand catapult. Because of their high efficiency, the tapered resilient band means do not require high draw force in order to produce high velocities.

The pouch 24 is flexible and preferably made of suede leather. Its compact design reduces dead weight power losses and more energy is therefore transferred to the pellet or missile to be hurled by the hand catapult.

A leather strap 30 is adapted to be secured to the handle 12 in order to reduce the strain on the wrist while shooting the hand catapult. Also, the leather strap can be used to carry the hand catapult and eliminate the chance of dropping the hand catapult between shots. The leather strap 30 has secured at an end a swivel bolt 32 which provides a means for affixing the leather strap 30 to the handle 12. The swivel bolt 32 will allow for easy length adjustment and yet hold the strap 30 securely.

A wrist brace attachment 34 may be used in place of the leather strap 30. The wrist brace 34 gives greater stability to the wrist for accurate aiming. The wrist brace 34 comprises an angled rod member having an externally threaded end 36 adapted to be secured to the handle 12. The rear of the wrist brace 34 is provided with an offset U-shaped member having resilient pads 38 and 40 carried thereon. The resilient pads 38, 40 which may be made from foam, for example, rest on the arm in two places for maximum comfort. The swivel connection of the wrist brace 34 to the handle 12 provides desired alignment of the wrist brace with the handle 12 and permits a natural, comfortable arm position to be assumed by the user. As an alternative the wrist brace attachment can be made from a rod member bent into generally a V-shape as viewed in plan. The apex is shaped so as to receive the bolt to connect the apex to the handle 12. The arms of the rod member are spaced apart and angled at the free ends to generally parallel relationship. A resilient pad is connected across the ends of the arms. The free ends of the arms of the rod member are angled in such manner that the pad will rest on the top of the arm of the user when the hand catapult is retained in use position by the user.

Figure 2:
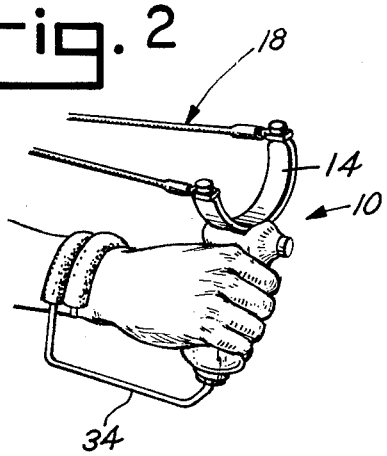
FIG. 2 is a perspective view illustrating the use of the hand catapult with the wrist brace attachment.
Figure 3:
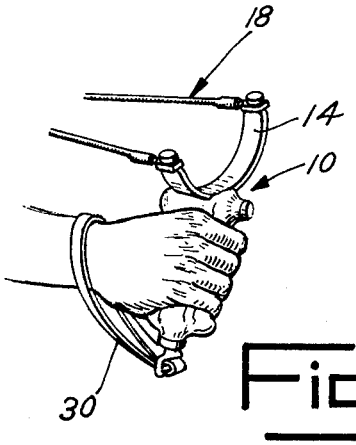
FIG. 3 is a perspective view illustrating the use of the novel hand catapult with a carrying strap attachment.

FIG. 2 illustrates the use position of a hand catapult 10 fitted with the wrist brace attachment 34 and FIG. 3 illustrates the hand catapult 10 carrying the leather strap 30 in place of the wrist brace 34.

Figure 4:
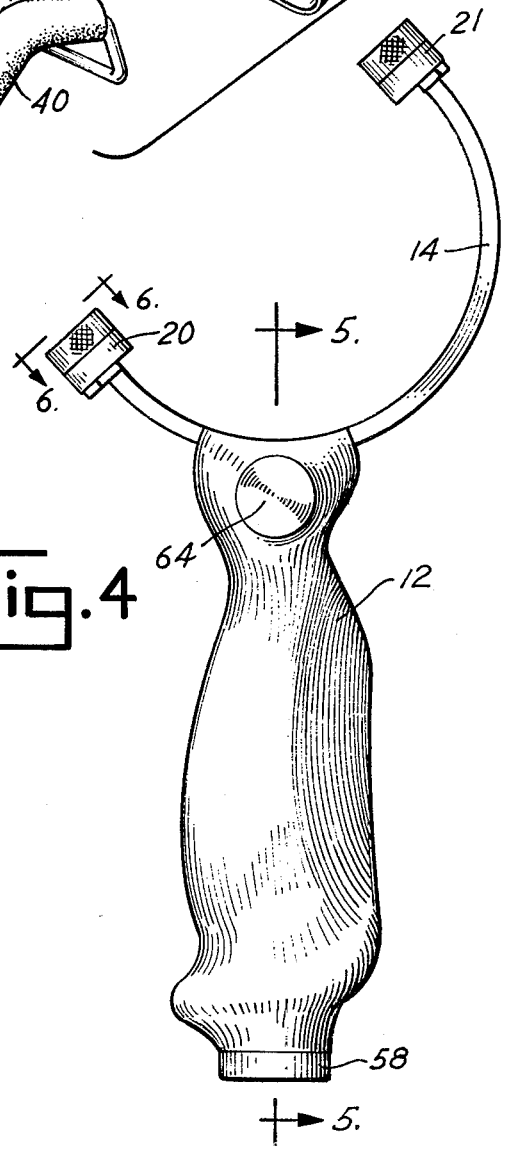
FIG. 4 is a front view of the hand catapult.

Referring now to FIGS. 4 and 5, there is better illustrated the construction of the handle 12. The handle comprises basically a molded or shaped exterior comprised of plastic, wood or the like material, that is designed to conform to the hand with maximum comfort, and handle core means comprising a rod-like handle core 46 and a cross piece 48, which are disposed in longitudinal and transverse openings 50 and 52, respectively, in the handle 12. The handle may be universal, that is, bilaterally symmetrical so that it can be comfortably held by either the left hand or the right hand. If desired, the handle 12 can be constructed so as to conform more closely to either the left hand or the right hand. The handle 12 is smooth and rounded and has an average circumference approximately between 11 and 16 cm with an oblong cross section oriented in a front to rear line. The handle 12 is short enough and curved to exert a slight squeezing action, pushing the fingers of the hand together for a firmer grip. The handle core 46 and cross piece 48, which are preferably fabricated from steel, provide the mounting means for accessories to be attached to the handle 12. The handle core 46 includes an internally threaded bore 54 in the top thereof and an interally threaded bore 56 in the bottom thereof. The threaded bore 54 in the top of the handle core 46 is adapted to receive the carriage bolt 16 which secures the carriage 14 to the handle 12. The threaded bore 56 in the bottom of the handle core 46 is adapted to receive the externally threaded nut member or base bolt 58. The nut member 58 is provided centrally with an internally threaded opening 60 for receiving accessories to be attached to the handle 12, as will be explained more fully hereinafter.

The cross piece 48 extends through the transverse opening 52 in the handle 12 into engagement with the opening 62 in the handle core 46. The carriage bolt 16 extends through the aligned openings formed in the handle core 46 and cross piece 48 into the bore 54 in order to secure the components to one another. An externally threaded front bolt 64 is adapted to close the end of the cross piece 48 and as will be explained hereinafter, the front bolt 64 may be used to permit affixation of accessories to the handle 12.

The carriage 14 was functionally designed for optimum spacing and maximum open area. As shown in FIGS. 1 and 4, the carriage 14 is offset relative to the handle 12 so as to provide for a horizontal alignment of the swivel bindings 20 and 21 during the most natural arm position. The preferred angle of offset is 45° as it has proven comfortable for a wide range of users. It is possible to adjustably secure the carriage to the handle 12 to widen the most comfortable range of use, for example, by providing additional holes in the carriage 14 or by providing a slot in the carriage. A range of 30°–60° offset of the carriage 14 relative to the handle 12 embraces the most comfortable aiming and cocking positions for most users. The offset arrangement of the carriage relative to the handle provides for a comfortable and less tiring position of the hand catapult in use.

The carriage 14 is generally U-shaped or semi-circular. Thus, all points on the carriage 14 are equidistant from the path of the missile, allowing the most unobstructed flight of the missile. The carriage 14 has a thin-wide profile, with the thin edge in line with the path of the missile, thus minimizing chances of ricocheting an improperly released missile.

With reference now to FIGS. 1, 4, 6, 7, 9, there is better illustrated the swivel carriage bindings for the present invention, which provide for maximum aiming accuracy and minimum resilient band wear.

From FIG. 1, it is seen that there is a swivel carriage binding 20, 21 at each end of carriage 14. In FIG. 9, it is seen that carriage 14 is provided at each end with a outwardly extending projection or binding post 70 having a threaded end 72. The portion 71 of projection 70 has a non-circular configuration in cross-section, for example, a square or rectangular configuration. The swivel carriage binding 20 includes bushing 74 which is adapted to fit over the projection 70 on the carriage 14. The bushing 74, which is preferably of plastic, has a non-circular opening complementary to that of the projection 70 and is, therefore, non-rotatably mounted on the projection 70. An annular sector portion 76 extends from the exterior surface of bushing 74 about 60°. The ends of the annular sector portion 76 will function as stops, as will be more fully explained hereinafter to limit the swivel action of the carriage bindings 20, 21 in order to prevent undesirable tangling of the resilient band means 18.

Rotatably mounted on the bushing 74 is a swivel washer 78 which includes a body portion 79 with an opening 81 therein and a lug 80 extending outwardly from the body portion 79. The opening 81 in swivel washer 78 is complementary to the exterior of the bushing 74 to maintain a smooth bearing surface for the swivel action of swivel washer 78 with respect to the bushing 74. Depending from the body 79 of swivel washer 78 is an annular sector 82 which provides at its ends stops that are adapted to cooperate with the ends of the annular sector 76 on the bushing 74. This arrangement will, therefore, provide for a limited rotational movement of the swivel washer 78 relative to the bushing 74 to prevent resilient band means tangling. A cap nut 84 is threaded on to the binding post 72 at each end of carriage 14 in order to maintain each swivel washer on a respective end of the carriage 14. The swivel action of washer 78 prevents the sort of band abrasion that is found in slingshots with fixed bindings. The band means 18 always pulls in line with the binding and never bends sharply around it. An advantage of the swivel connection arrangement is that it is possible to replace a swivel washer by unscrewing a cap nut.

Turning now to FIGS. 10–14, there is illustrated an ammunition tube attachment that is adapted to be secured to the handle 12 of the present invention. The ammunition tube attachment or accessory 90 includes a tube 91 for receiving a plurality of missiles, pellets or steel balls. Preferably, the balls are of steel and perfectly round for most accurate short or long range shooting. Secured to the top of the tube 91 by a knurled cap bolt 92 is an angle bracket 93, which is adapted to be secured to the handle 12 by means of the bolt 64. At the lower end of the tube 91 which may be of plastic, is secured a body 94 having a single ball dispenser button 95 operatively movable therein. The body 94 has at one end an opening 97 adapted to receive the base bolt 58 for fastening the body 94 securely to the bottom of the handle 12.

With reference to FIGS. 11, 12, 13 and 14 there is better shown the detail of the ammunition tube attachment 90. The body 94 is comprised of a pair of sheet metal members **94*a*, 94*b* that are essentially planar at one end and formed with opposing generally semi-circular recesses at the other end to define a cavity for the dispensing button 95. The base bolt 58 is secured to the handle core 46 so as to retain the substantially planar end of the body 54 on the lower portion of the handle. The button 95 is inserted into the body cavity and retained therein by means of the cooperation between upwardly bent tab 98 on the body and a recess 99 in the bottom of the button 95. The recess 99 extends longitudinally, then transversely, then longitudinally in order to provide means for detachably securing the button 95 within the body cavity. Disposed between the walls defining the cavity in body 94 and the end of the button 95 is a spring 100 which is adapted to bias the button 95 to outward position as shown in FIG. 11. In this position, the lowermost ball or pellet 101 is retained within the groove passage 102 within the button 95. When the button is actuated to the left as viewed in FIG. 12, the opening 102 is in alignment with the opening 103 in body 194 and the lowermost pellet 101** is dropped from the ammunition tube into the hands of the user.

The button 95 is provided with a cammed surface 105 which will urge the ball adjacent the lowermost ball upwardly as the button 95 is moved inwardly into the body 94 or toward the left as viewed in FIG. 12. When the button is released, the spring 100 will urge the button 95 to the right to the position shown in FIG. 11 and the next ball will drop into position, as shown, ready for release upon next actuation of the button 95. The projection or tab 98 will ride in groove 99 as shown best in FIG. 13 so as to guide the button 95 and prevent undesirable rotation of the button 95 within the body 94.

Figure 15:
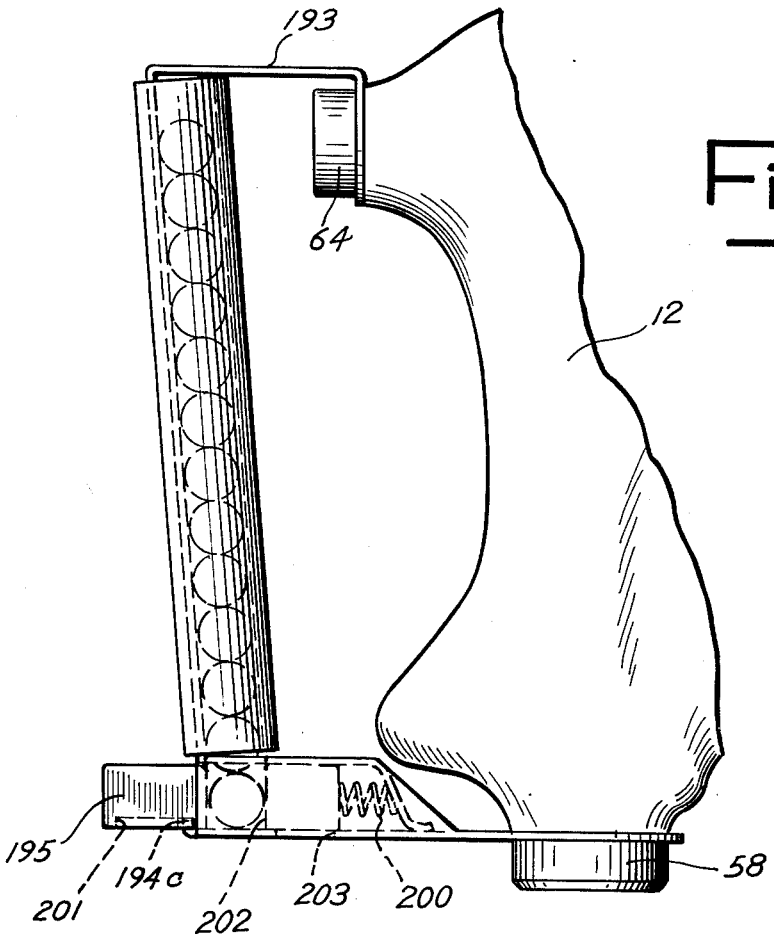
FIG. 15 is an elevation view of a modified ammunition tube attachment.
Figure 16:
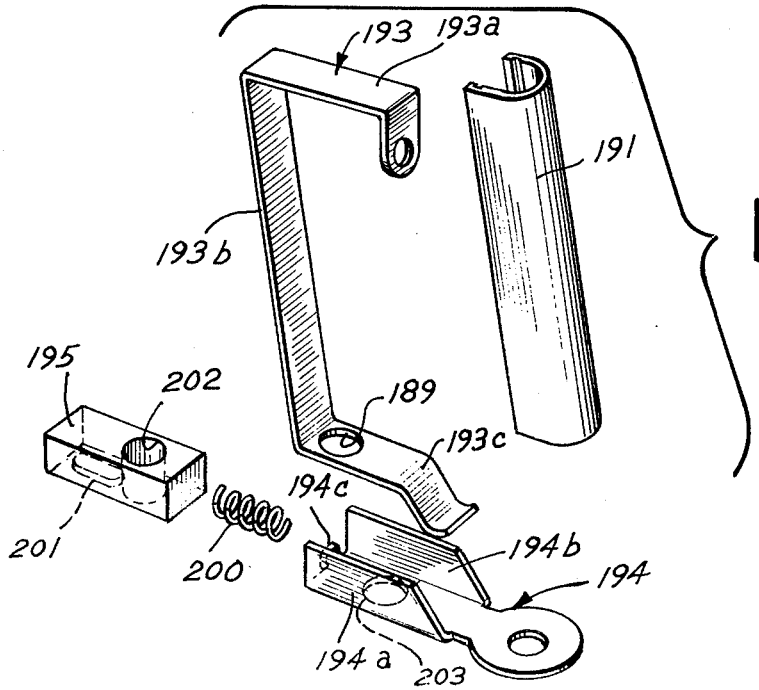
FIG. 16 is a perspective exploded view of the modified ammunition tube attachment of FIG. 15.

FIGS. 15 and 16 show a modification of the ammunition tube attachment. In the modification, the bracket 193 provides the frame and includes an angle portion **193*a* at the top connected to handle 12 by front bolt 64, a depending arm 193*b*, which cooperates with an extrusion housing 191 to retain the supply of balls therein, and a lower arm portion 193*c* which cooperates with the base 194 to define a body for receiving button 195. Base 194 is connected to the handle 12 by base bolt 58 which extends through opening 197 in the base 194 into the opening in the bottom of the handle core. Base 194 includes sides 194*a* and 194*b*, which are parallel to one another and are closely spaced from the sides of the button 195, which is generally rectangular in cross-section. The button has a groove in the bottom which receives upstanding tab 194*c* to retain the button in the body. Spring 200 biases the button outwardly from the body and manual force is used to urge the button 195 inwardly. The button 195 is positioned outwardly with openings 189 and 202 in alignment. A ball is received in the opening 202. To dispense a single ball, the button 195 is moved inwardly to compress spring 200 and align openings 202 and 203. When the openings 202 and 203 are aligned, a ball is dispensed. Upon release of the button 195, spring 200 will bias the button 195 back to its initial position, with openings 189 and 202** in alignment.

In order to use the improved hand catapult 10, grip the handle 12 in one hand, for example, right hand, and place a ball in the pouch of the resilient band means 18 with the other hand. Grasp the pouch with the thumb and first finger of the left hand. The user should stand sideways or at about right angles to the face of the target. The hand catapult 10 should be positioned with the handle 12 at about 45° from the vertical so that the carriage swivel bindings 20, 21 and the plane of the stretched resilient band means 18 will be parallel to the ground. This is the most natural position for the arm. The band means 18 should always be drawn in a horizontal plane so that they may work evenly with relation to gravity. The novel hand catapult of this invention with offset carriage allows both proper hand alignment and natural arm positioning. While the handle 12 of the hand catapult 10 is held in the outstretched right hand, the band means 18 is fully cocked or tensioned, with the band means 18 in a horizontal plane. The user aims at the target and slowly releases the pouch.

There has been provided by the present invention a hand catapult designed with modular components and accessories that provide desirable versatility and interchangeability of parts. The offset carriage provides for an anatomically natural arm position of the user while maintaining proper band positioning. The handle conforms to the hand. The novel swivel carriage bindings provide maximum aiming accuracy and minimum band wear. The interchangeability of components is enhanced by the handle core which forms a part of the present invention.

While I have shown presently preferred embodiments of the present invention, it will be understood by those skilled in the art that it is susceptible of modification and change and it is desired to limit the scope of the invention only by the appended claims.

What is claimed is:

1. A hand catapult including a handle adapted to be gripped by the hand of the user, handle core means within the handle for mounting attachments to the handle, said handle core means comprising a longitudinally extending handle core, said handle core being provided with an internally threaded opening in the bottom, a carriage secured to the top of the handle, resilient band means for hurling a missile, swivel carriage bindings for swivelly connecting the resilient band means to the carriage, and attachments for steadying the hand catapult in use adapted to be selectively secured to the internally threaded opening in the bottom of the handle core.

2. A hand catapult as in claim 1 wherein one of said attachments is a wrist strap.

3. A hand catapult as in claim 1 wherein another of said attachments is a wrist brace, which comprises an angulated rod having one end threaded within the bottom internally threaded opening in the handle core, and resilient pad means on the other end adapted to contact the forearm of the user.

4. A hand catapult including a handle adapted to be gripped by the hand of the user, handle core means within the handle for mounting attachments to the handle, said handle core means comprising a longitudinally extending handle core having an internally threaded opening in the bottom and a transverse cross piece, a carriage secured to the top of the handle, resilient band means for hurling a ball, swivel carriage bindings for swivelly connecting the resilient band means to the carriage, said cross piece having an internally threaded opening at one end, and an ammunition tube attachment adapted to be connected to the handle via the openings in the cross piece and the bottom of the handle core respectively, said ammunition tube attachment retaining a supply of balls.

5. A hand catapult as in claim 4 wherein the ammunition tube includes a button for dispensing balls one at a time from the ammunition tube attachment.

6. A hand catapult including a handle adapted to be gripped by the hand of the user, a carriage secured to the top of the handle, resilient band means for hurling a missile, and swivel carriage means for swivelly connecting the resilient band means to the carriage, said carriage formed generally U-shaped and having a post at each end, each post being disposed in a generally upright position when the hand catapult is in use, a bushing non-rotatably carried on each post, the center-line axes of the posts being substantially parallel to each other and each axis forming an angle with the longitudinal axis of the hand catapult and said swivel carriage means comprises a swivel carriage binding on each bushing, each swivel carriage binding including a swivel washer rotatably carried on said bushing for rotation about the axis of each post and a lug extending therefrom, the resilient band means secured at each side to a lug, said resilient band means being pulled in line with the swivel carriage bindings, whereby the swivel washer rotates to minimize abrasion of the resilient band means in use, said swivel carriage bindings being positioned in a plane generally horizontal to the ground when the hand catapult is used.

7. A hand catapult as in claim 6 wherein the centerline axes of the posts are offset about 45° from the longitudinal axis of the handle so as to position the swivel carriage bindings in a plane generally horizontal to the ground when the hand catapult is used.

8. A hand catapult as in claim 6 wherein said carriage has an opening therein offset about45° from the center line between the axes of the posts that bisects the carriage and bolt means extending through the opening in the carriage for joining the carriage to the handle.

9. A hand catapult as in claim 6 including a handle core means within the handle, said handle core means comprising a longitudinally extending handle core said carriage having an opening offset from the centerline between the axes of the posts that bisects the carriage, and means extending through the opening in the carriage and cooperating with the upper end of the handle core for securing the carriage in offset relationship to the longitudinal axis of the handle.

10. A hand catapult as in claim 9, wherein the handle core is provided with internally threaded openings at each end.

11. A hand catapult as in claim 10 including bolt means for securing the carriage to the handle means, said bolt means extending through the opening in the carriage into an internally threaded opening in the top of the handle core.

12. A hand catapult as in claim 6 including complementary stop means carried on said bushing and swivel washer, respectively, to limit rotation of said swivel washer relative to said bushing.

13. A hand catapult including a handle adapted to be gripped by the hand of the user, a carriage secured to the top of the handle in an upright position, said carriage being formed generally U-shaped with a post at each end, each post being disposed in a generally upright position when held during use, the centerline axes of the posts being substantially parallel to each other and each axis forming an angle of about 45 degrees with the longitudinal axis of the hand catapult, resilient band means for hurling a missile, and a swivel carriage binding pivoted on each post about the axis of each post for swivelly connecting the resilient band means to the carriage so that the resilient band means are pulled in line with the swivel carriage bindings which pivot on the posts to minimize abrasion of the resilient band means in use, said swivel carriage bindings being positioned in a plane generally horizontal to the ground when the hand catapult is used so as to provide for a comfortable and less tiring position of the hand catapult in use.

* * * * *